US008936044B1

(12) United States Patent
Chen

(10) Patent No.: US 8,936,044 B1
(45) Date of Patent: Jan. 20, 2015

(54) POUCH AIR VALVE USED ON SEALING POUCHES

(71) Applicant: Wei Ling Chen, Taichung (TW)

(72) Inventor: Wei Ling Chen, Taichung (TW)

( * ) Notice: Subject to any disclaimer, the term of this patent is extended or adjusted under 35 U.S.C. 154(b) by 0 days.

(21) Appl. No.: 13/938,569

(22) Filed: Jul. 10, 2013

(51) Int. Cl.
*F16K 15/14* (2006.01)
*F16K 15/00* (2006.01)

(52) U.S. Cl.
CPC ..... *F16K 15/00* (2013.01)
USPC ..... 137/846; 137/315.33; 383/103

(58) Field of Classification Search
CPC ..... B65D 81/2083; F16K 15/147
USPC ..... 137/234.5, 315.33, 844, 846; 383/100–103; 220/89.1, 89.3, 203.11, 220/203.17; 206/524.8
See application file for complete search history.

(56) References Cited

U.S. PATENT DOCUMENTS 7,614,203 B2 * 11/2009 Oltrogge ..... 53/434
7,748,398 B2 * 7/2010 Miller ..... 137/68.29
7,997,047 B1 * 8/2011 Sargent ..... 53/79
8,307,864 B2 * 11/2012 Dobkins ..... 141/329
8,720,468 B2 * 5/2014 Chen ..... 137/15.19
2009/0026401 A1 * 1/2009 Dobkins ..... 251/149.6

* cited by examiner

*Primary Examiner* — John Rivell
*Assistant Examiner* — Reinaldo Sanchez-Medina
(74) *Attorney, Agent, or Firm* — Muncy, Geissler, Olds & Lowe, P.C.

(57) ABSTRACT

A pouch air valve used on a sealing pouch comprises a coupling duct and a piercing base. The coupling duct includes a duct, an air valve and a first suction plate. The piercing base has a piercing head and a second suction plate. The first suction plate surrounds and seals the duct to form coupling therewith. The piercing head has an airflow passage running through two sides thereof. The second suction plate surrounds and seals the piercing head to form coupling therewith. The piercing base is positioned at one side of the sealing pouch while the duct is directly aligned and coupled with the piercing head from another side of the sealing pouch so that the piercing head can pierce through the sealing pouch to allow the first and second suction plates to attract each other and anchor on the sealing pouch which serves as separation.

7 Claims, 12 Drawing Sheets

POUCH AIR VALVE USED ON SEALING POUCHES

FIELD OF THE INVENTION

The present invention relates to a sealing pouch and particularly to an air suction and inflation structure for sealing pouches.

BACKGROUND OF THE INVENTION

Please refer to FIG. 1, a conventional sealing zipper bag 1 can be incorporated with an air valve 2 by bonding and sealed after being filled with food. Then extra air inside the zipper bag 1 can be drawn out through the air valve 2 via an air suction element (not shown in the drawing) so that the interior of the zipper bag 1 is vacuum to prevent the food from oxidizing or damping to increase food preservation period.

Or freshness gas such as nitrogen that is inertia in nature can be inflated into the zipper bag 1 through the air valve 2 via a gas inflation element (not shown in the drawing) to slow down food spoiled speed and maintain food freshness.

Depending on different requirements of air suction or gas inflation, a two-way valve can be selected to be the air valve 2 to perform air suction and gas inflation, a one-way valve also can be selected to bond to the zipper bag 1 in a specific direction. Such a structure not only increases air suction or gas inflation efficiency, also enhances airtight efficacy to meet use requirements.

Although the aforesaid conventional technique can meet use requirements by vacuuming or inflating the zipper bag 1, taking into account of airtight efficacy, the air valve 2 must be bonded securely to the zipper bag 1. In the event that the zipper bag 1 is no longer usable and has to be discarded, the air valve 2 also is thrown away. This not only creates additional environmental burden, but also increases the production cost of the zipper bag 1 with the air valve 2 to result in higher price of the zipper bag 1 and cannot fully meet use requirements.

To remedy the aforesaid disadvantages, referring to FIGS. 2 and 3, Applicant of this invention has proposed a pouch air valve 3 that can be repeatedly installed and removed when in use. The pouch air valve 3 comprises a duct 4, an air valve 5, a first suction plate 6 and a second suction plate 7. The duct 4 has a central passage 8 running through two sides thereof. The air valve 5 clogs and seals the central passage 8. The first and second suction plates 6 and 7 are securely coupled on the outer wall of the duct 4 to attract each other.

Also referring to FIG. 3, when in use, the pouch air valve 3 must be incorporated with a pliable sealing pouch 9, and the sealing pouch 9 mush have an aperture 9A formed thereon which is smaller than the suction area between the first and second suction plates 6 and 7 to allow the duct 4 to pass through so that the first and second suction plates 6 and 7 are positioned at two sides of the sealing pouch 9 and separated by the sealing pouch 9 to attract each other. Such a structure allows the pouch air valve 3 to be mounted onto and removed from varying sealing pouches 9 and used repeatedly.

However, when the pouch air valve 3 is in use the sealing pouch 9 must have the aperture 9A formed thereon in advance and an extra aperture punch means has to be prepared for such purpose, or the sealing pouch 9 with the aperture 9A preformed thereon must be procured. All this creates extra problems in use and lowers use desire.

SUMMARY OF THE INVENTION

Therefore the primary object of the present invention is to provide a pouch air valve adopted for use on sealing pouches without perforation in advance to improve usability.

To achieve the foregoing object, the pouch air valve according to the invention comprises a coupling duct and a piercing base. The coupling duct includes a duct, an air valve and a first suction plate. The duct has a central passage running through two sides thereof. The air valve clogs and seals the central passage. The first suction plate surrounds and seals the duct to form coupling therewith.

The piercing base has a piercing head and a second suction plate. The piercing head has an airflow passage running through two sides thereof and corresponding to the diameter of the duct. The second suction plate surrounds and seals the piercing head to form coupling therewith. The piercing head can pierce into the duct so that the first and second suction plates attract each other.

Thus, the piercing base can be positioned at one side of the sealing pouch, while the duct of the coupling duct is directly aligned and coupled with the piercing head of the piercing base to pierce through the sealing pouch from another side of the sealing pouch such that the first and second suction plates attract each other via separation of the sealing pouch, thereby to finish installation of the pouch air valve on the sealing pouch. Hence there is no need to form an aperture on the sealing pouch in advance, and direct installation can be made on a desired location according to use requirement.

The foregoing, as well as additional objects, features and advantages of the invention will be more readily apparent from the following detailed description, which proceeds with reference to the accompanying embodiments and drawings. The embodiments serve merely for illustrative purpose and are not the limitation of the invention.

DETAILED DESCRIPTION OF THE PREFERRED EMBODIMENTS

Figure 1:
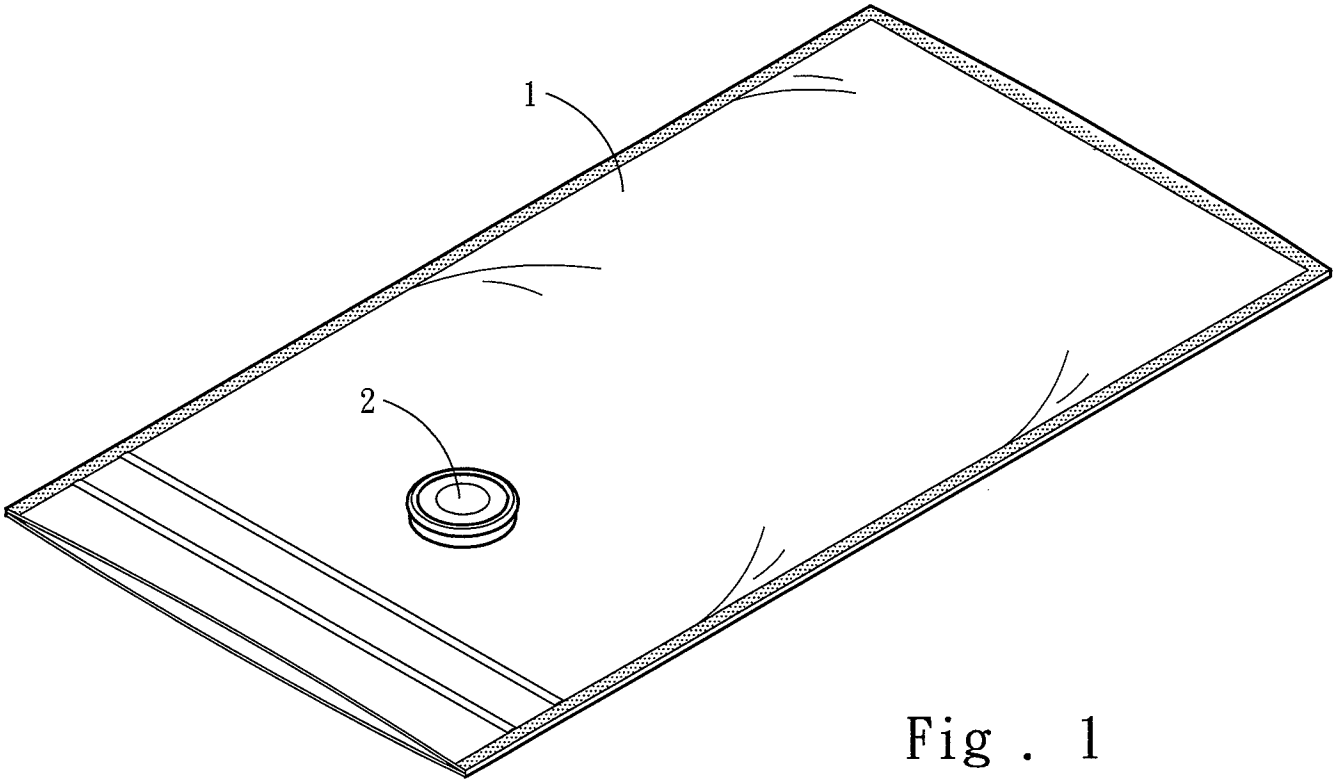
Fig. 1 PRIOR ART
FIG. 1 is a perspective view of a conventional zipper bag with an air valve.
Figure 2:
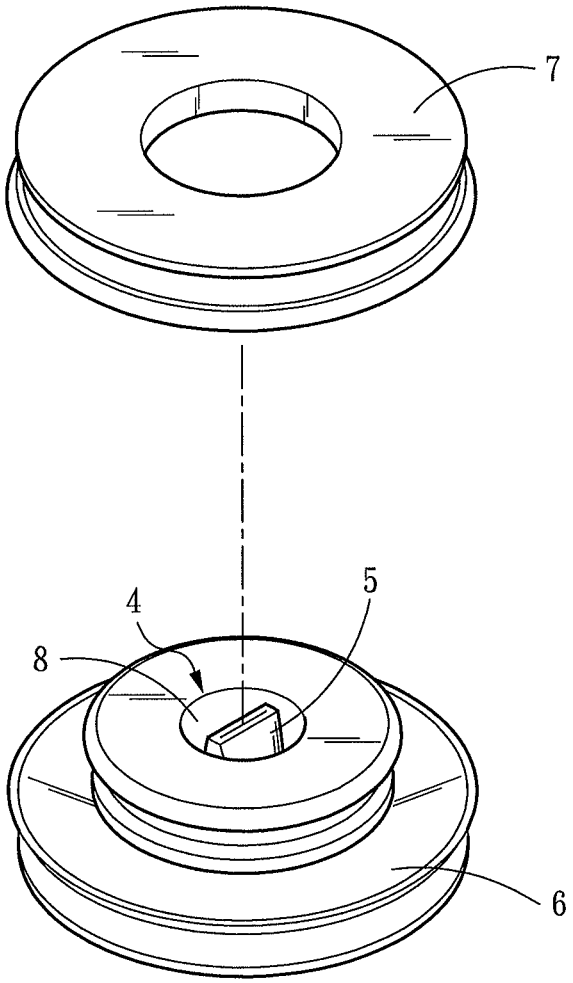
Fig . 2 PRIOR ART
FIG. 2 is an exploded view of a conventional pouch air valve.
Figure 3:
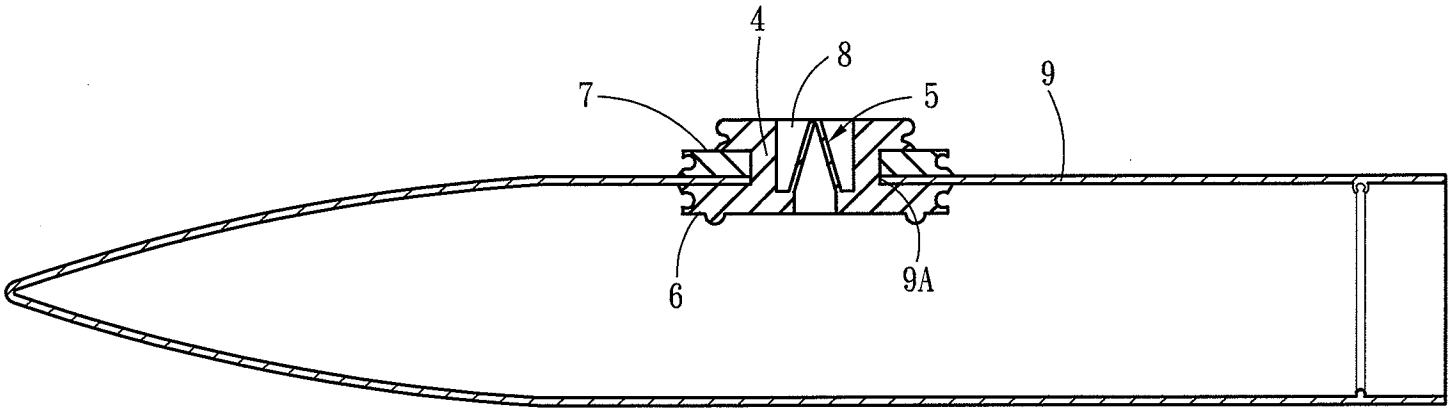
Fig. 3 PRIOR ART
FIG. 3 is a schematic view of a conventional zipper bag with an air valve in a use condition.
Figure 4:
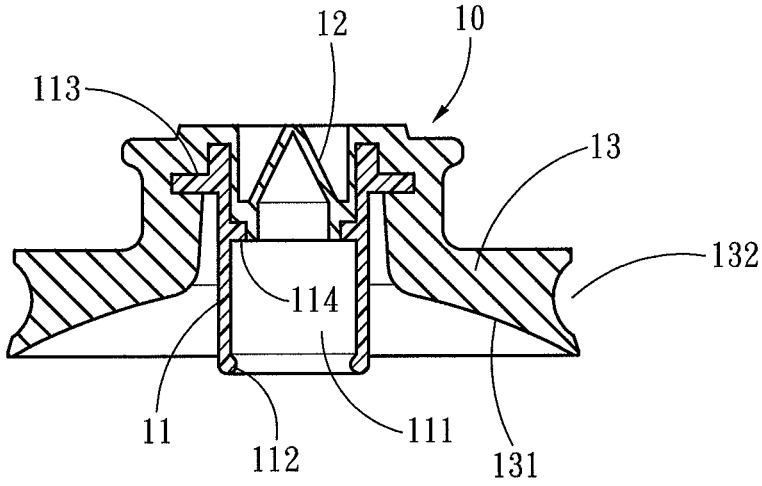
FIG. 4 is a schematic view of a coupling duct of the invention.
Figure 5:
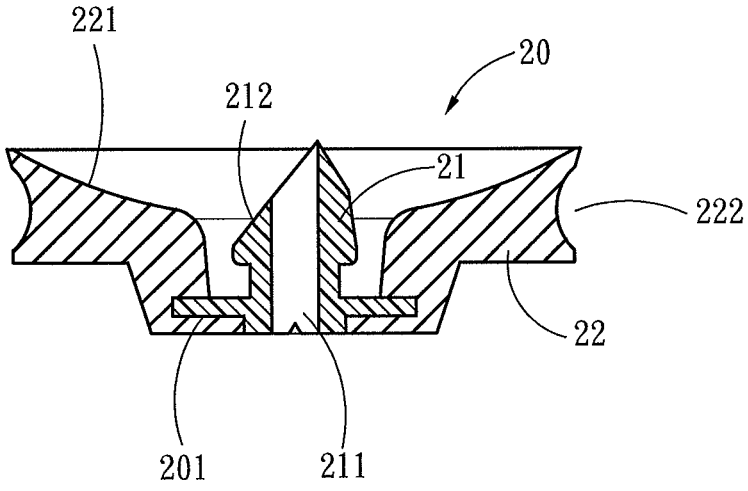
FIG. 5 is a schematic view of a piercing base of the invention.

Please refer to FIGS. 4 and 5, the present invention comprises a coupling duct 10 and a piercing base 20. The coupling duct 10 includes a duct 11, an air valve 12 and a first suction plate 13. The duct 11 has a central passage 111 running through two sides thereof. The air valve 12 clogs and seals the central passage 111. The first suction plate 13 surrounds and seals the duct 11 to form coupling therewith.

The piercing base 20 has a piercing head 21 and a second suction plate 22. The piercing head 21 has an airflow passage 211 running through two sides thereof and corresponding to the diameter of the duct 11. The second suction plate 22 surrounds and seals the piercing head 21 to form coupling therewith. The piercing head 21 can pierce into the duct 11 so that the first and second suction plates 13 and 22 can attract each other. The piercing head 21 has a sharpened edge 212 at a front end thereof. The first and second suction plates 13 and 22 further have respectively an arched suction surface 131 and 221 to attract each other. The duct 11 has an inner rim flange 112 to tightly couple on the piercing head 21.

In addition, the first suction plate 13 and air valve 12 can be integrally formed to enhance air tight efficacy. The duct 11 also has a transverse outer flange 113 extended from the outer wall thereof to latch the first suction plate 13, and a transverse inner flange 114 extended from the inner wall thereof to latch the air valve 12, thereby to enhance the air tight stability of coupling between the first suction plate 13 and air valve 12 with the duct 11. Similarly, the piercing base 20 also has a transverse flange 201 to latch the second suction plate 22 to enhance the air tight stability of coupling between the second suction plate 22 and piercing base 20. The first and second suction plates 13 and 22 further have respectively an annular groove 132 and 222 on the circumferences thereof to enhance the strength of the first and second suction plates 13 and 22 without easily warping.

Figure 6A:
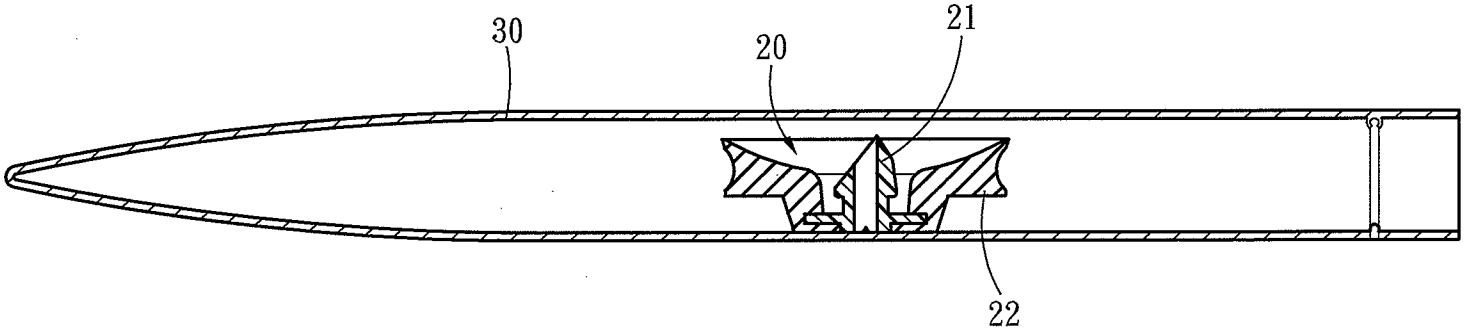
FIGS. 6A through 6E are schematic views of the invention in installation conditions.
Figure 6B:
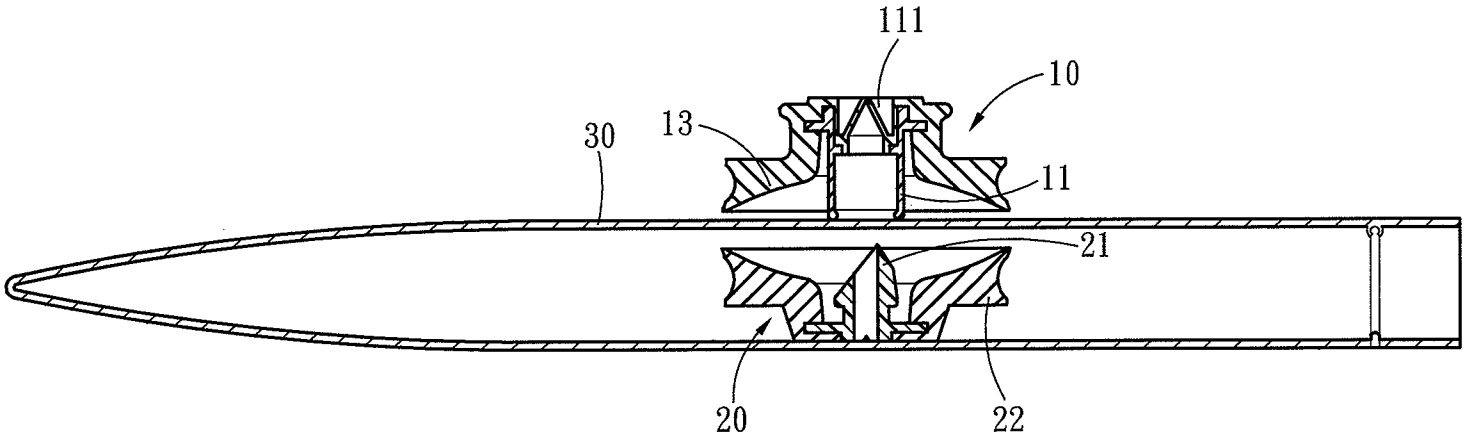
Figure 6C:
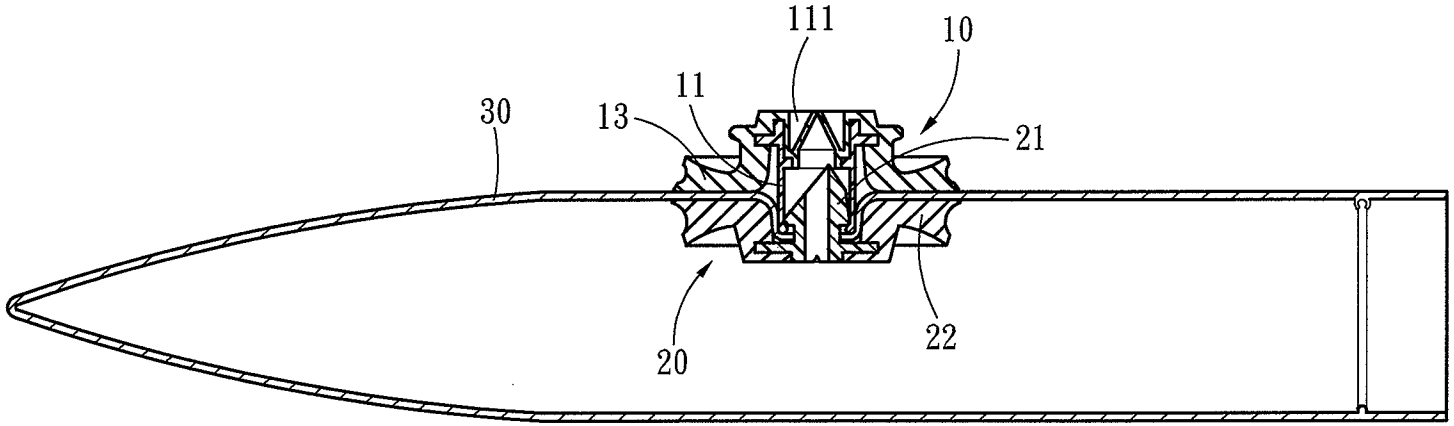
Figure 6D:
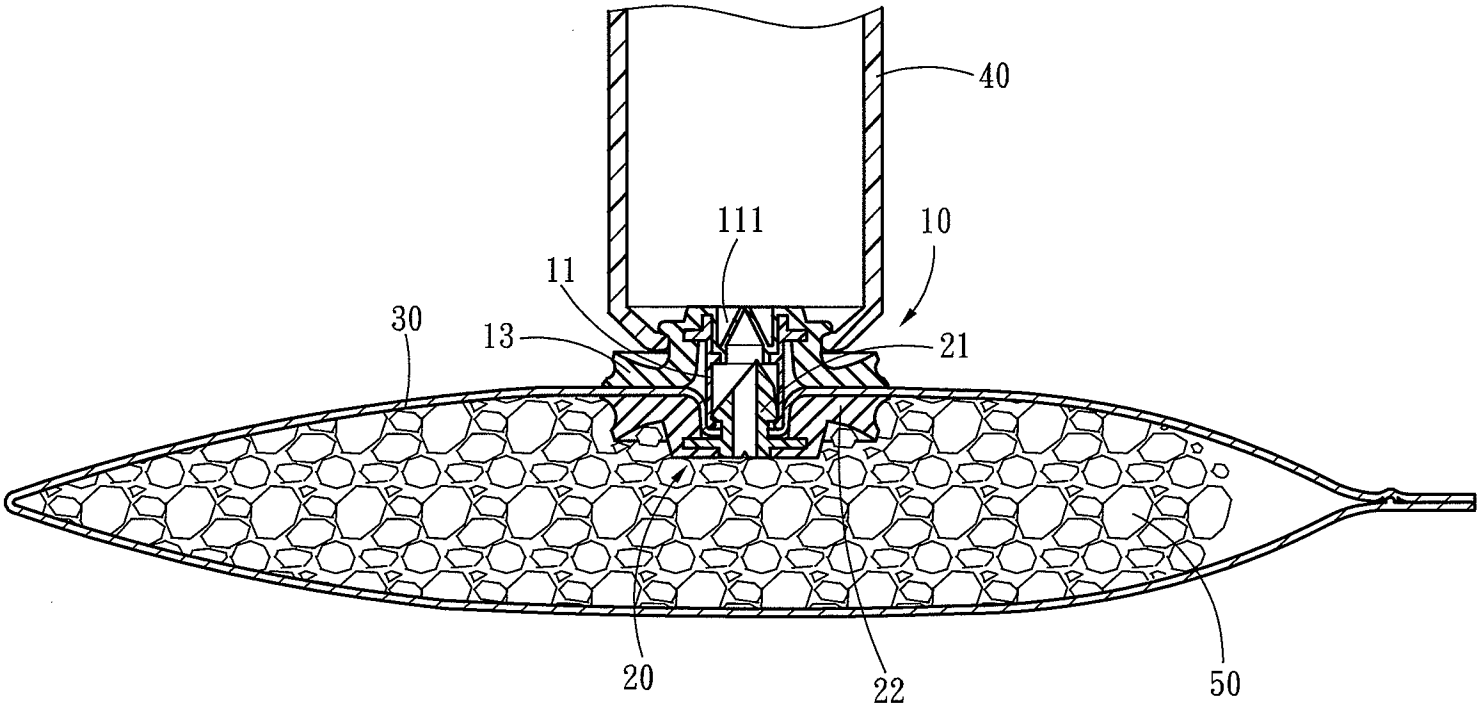
Figure 6E:
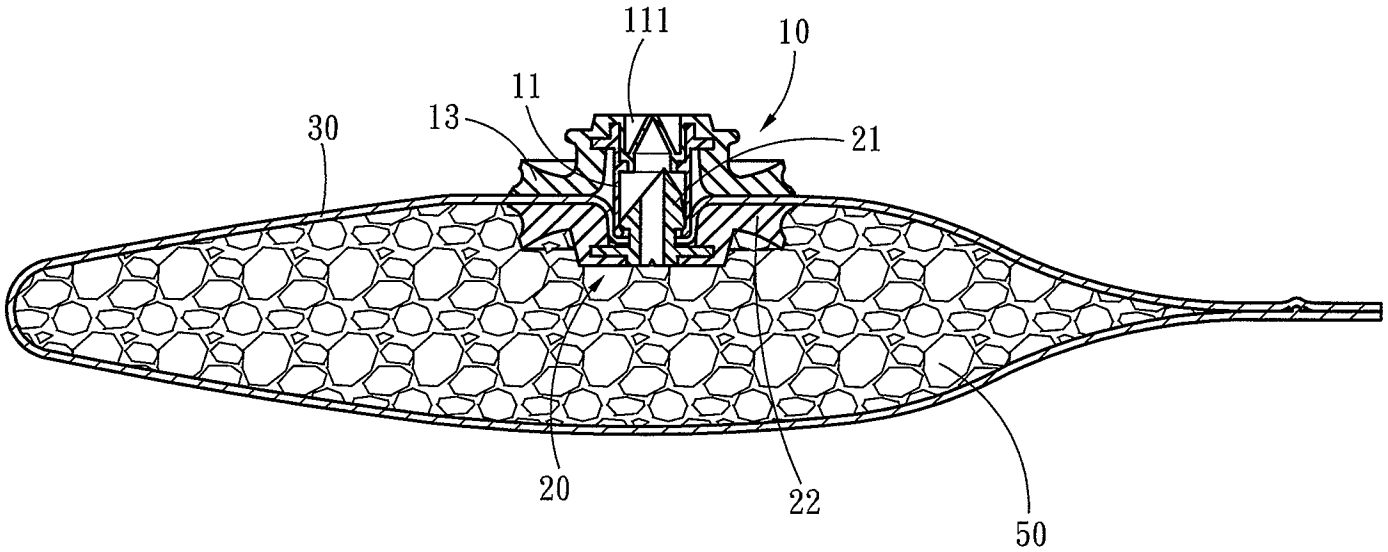

Please refer to FIGS. 6A through 6E, when the aforesaid pouch air valve 12 is in use, the processes involved are as follows:

First, prepare a sealing pouch 30, and dispose the piercing base 20 inside the sealing pouch 30 (referring to FIG. 6A);

Next, align the duct 11 of the coupling duct 10 to the piercing head 21 of the piercing base 20 from another side of the sealing pouch 30 (referring to FIG. 6B);

Next, pierce the sealing pouch 30 with the piercing head 21 to allow the first and second suction plates 13 and 22 to attract each other via the separation of the sealing pouch 30 (referring to FIG. 6C);

Next, dispose foodstuff 50 into the sealing pouch 30 and seal the sealing pouch 30; and then engage the central passage 111 with an air suction element 40 (referring to FIG. 6D); and Finally, suck the air from the sealing pouch 30 and expel the air outside (referring to FIG. 6E).

In addition of expelling the air from the sealing pouch 30 through the air suction element 40 as previously discussed, the sealing pouch 30 also can be directly squeezed to form a pressure difference to directly expel the air from the sealing pouch 30.

Figure 7:
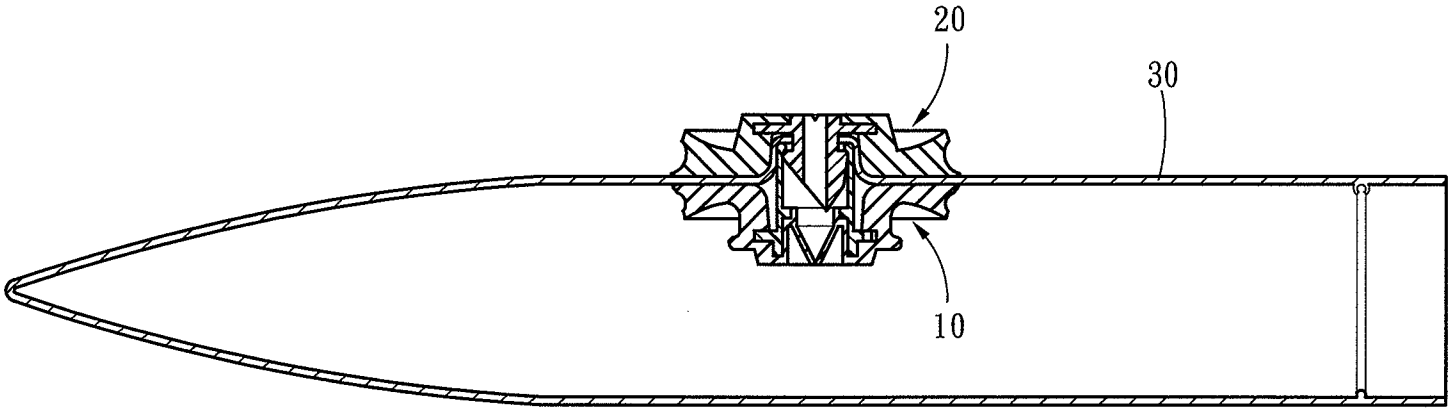
FIG. 7 is a sectional view of another embodiment of the pouch air valve of the invention.
Figure 8A:
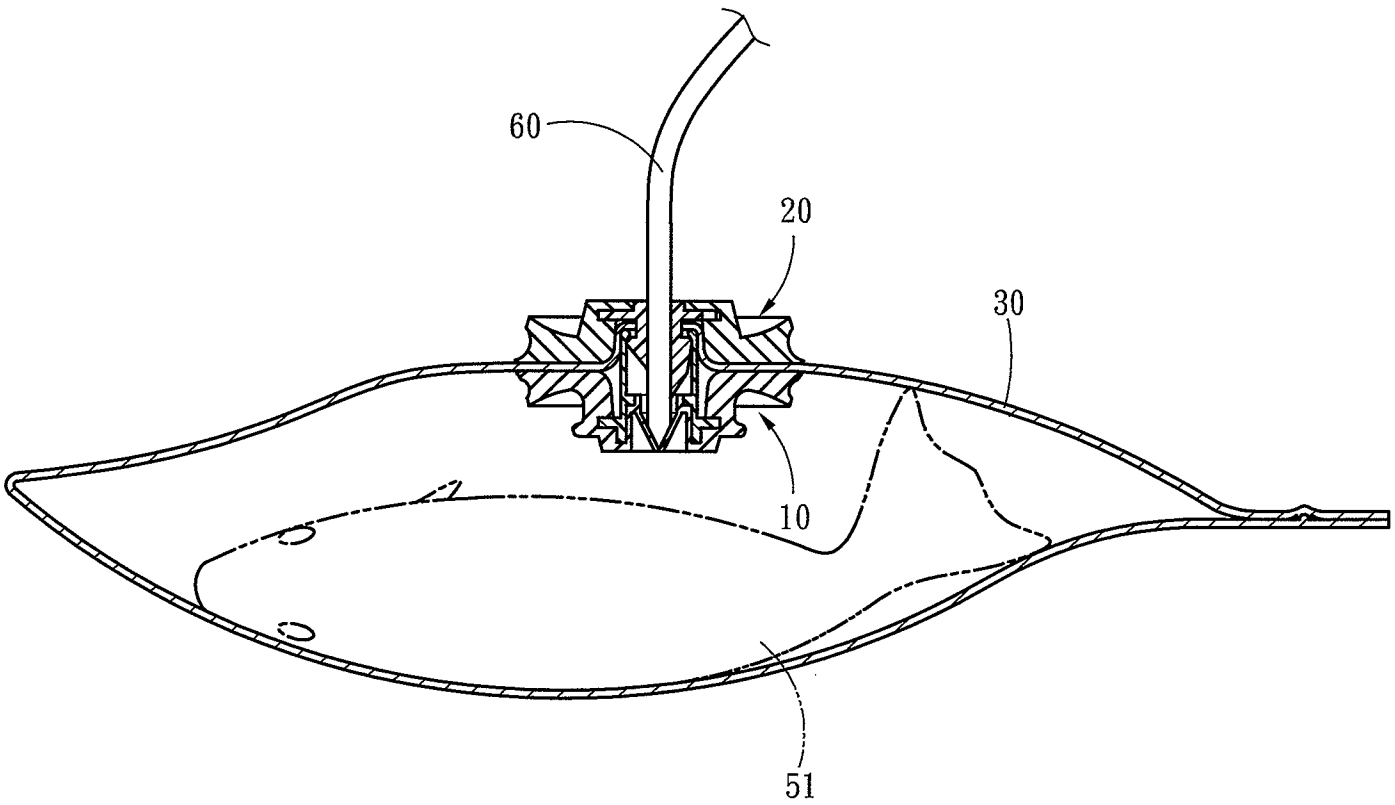
FIGS. 8A and 8B are schematic views of another embodiment of the pouch air valve of the invention in use conditions.
Figure 8B:
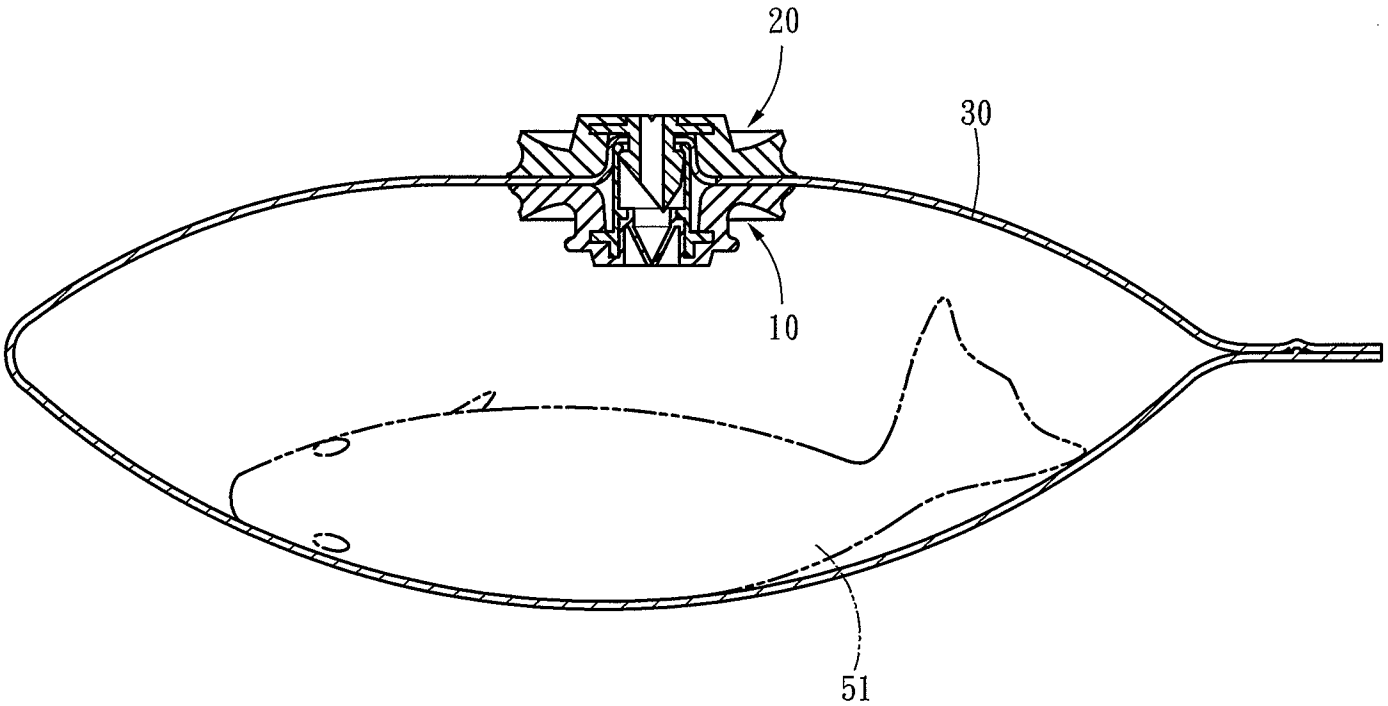

Please refer to FIGS. 7, 8A and 8B, in another embodiment of the invention, the coupling duct 10 and piercing base 20 can also be installed in an inverse manner. i.e., the coupling duct 10 is held in the sealing pouch 30, while the piercing base 20 pierces through the sealing pouch 30 from another side of the sealing pouch 30. Then a fresh foodstuff 51 such as fish can be disposed into the sealing pouch 30, and freshness gas can be inflated into the sealing pouch 30 through a gas inflation element 60 (referring to FIGS. 8A and 8B).

As a conclusion, the invention can be installed on various types of sealing pouches without perforation in advance. It also can be installed directly on a desired location according to requirements, hence can meet use requirements.

What is claimed is:

1. A pouch air valve used on a sealing pouch, comprising:

a coupling duct which includes a duct, an air valve and a first suction plate; the duct including a central passage running through two sides thereof, the air valve clogging and sealing the central passage, the first suction plate surrounding and sealing the duct for coupling therewith; and a piercing base which includes a piercing head and a second suction plate; the piercing head including an airflow passage corresponding to a diameter of the duct and running through two sides thereof, the second suction plate surrounding and sealing the piercing head for coupling therewith, the first and second suction plates attracting each other while the piercing head pierces into the duct;

wherein the first suction plate and the air valve are integrally formed.

2. The pouch air valve of claim 1, wherein the duct includes a transverse outer flange extended from an outer wall thereof to latch the first suction plate and a transverse inner flange extended from an inner wall thereof to latch the air valve.

3. The pouch air valve of claim 1, wherein the piercing base includes a transverse flange to latch the second suction plate.

4. The pouch air valve of claim 1, wherein the first suction plate and the second suction plate include respectively an annular groove on circumferences thereof.

5. The pouch air valve of claim 1, wherein the piercing head includes a sharpened edge at a front end thereof.

6. The pouch air valve of claim 1, wherein the first suction plate and the second suction plate include respectively an arched suction surface to attract each other.

7. The pouch air valve of claim 1, wherein the duct includes an inner rim flange to tightly couple on the piercing head.

* * * * *